US009181733B2

(12) United States Patent
Fujiwara et al.

(10) Patent No.: US 9,181,733 B2
(45) Date of Patent: Nov. 10, 2015

(54) VEHICLE DOOR HANDLE SYSTEM

(75) Inventors: Hiroto Fujiwara, Miyazaki (JP); Koichi Sakamoto, Saitama (JP); Yuujiro Tashima, Saitama (JP)

(73) Assignees: Kabushiki Kaisha Honda Lock, Miyazaki (JP); Honda Motor Co., Ltd., Tokyo (JP)

( * ) Notice: Subject to any disclaimer, the term of this patent is extended or adjusted under 35 U.S.C. 154(b) by 626 days.

(21) Appl. No.: 12/986,357

(22) Filed: Jan. 7, 2011

(65) Prior Publication Data

US 2011/0179602 A1 Jul. 28, 2011

(30) Foreign Application Priority Data

Jan. 28, 2010 (JP) ..... 2010-016603
Jan. 28, 2010 (JP) ..... 2010-016604

(51) Int. Cl.

| | |
|---|---|
| ***E05B 3/00*** | (2006.01) |
| ***E05B 79/06*** | (2014.01) |
| ***E05B 77/06*** | (2014.01) |
| ***E05B 85/18*** | (2014.01) |
| *E05B 13/00* | (2006.01) |

(52) U.S. Cl.

CPC ..... *E05B 79/06* (2013.01); *E05B 77/06* (2013.01); *E05B 85/18* (2013.01); *Y10T 16/458* (2015.01)

(58) Field of Classification Search

CPC ..... E05B 85/16; E05B 77/06; E05B 1/003
USPC ..... 292/336.3, DIG. 23, DIG. 65, DIG. 31, 292/DIG. 22, 344, 336.5, 358, 359, 80, 129, 292/30; 16/412, 110.1
See application file for complete search history.

(56) References Cited

U.S. PATENT DOCUMENTS

| | | | | | |
|---|---|---|---|---|---|
| 2,605,648 | A | * | 8/1952 | Sanderlin et al. | 74/528 |
| 2,872,236 | A | * | 2/1959 | Check | 292/336.3 |
| 2,949,329 | A | * | 8/1960 | Shoalts | 292/336.3 |
| 3,745,796 | A | * | 7/1973 | Fleming | 70/81 |
| 3,967,844 | A | * | 7/1976 | Torii et al. | 292/336.3 |
| 4,343,501 | A | * | 8/1982 | Meeks | 292/336.3 |
| 4,886,309 | A | * | 12/1989 | Shimura | 292/336.3 |
| 4,907,833 | A | | 3/1990 | Ogasawara et al. | |
| 5,011,202 | A | * | 4/1991 | Kato et al. | 292/336.3 |

(Continued)

FOREIGN PATENT DOCUMENTS

| | | | |
|---|---|---|---|
| EP | 0 724 051 | A1 | 7/1996 |
| JP | 60-253678 | A | 12/1985 |

(Continued)

*Primary Examiner* — Kristina Fulton
*Assistant Examiner* — Faria Ahmad
(74) *Attorney, Agent, or Firm* — Carrier Blackman & Associates, P.C.; Joseph P. Carrier; William D. Blackman

(57) ABSTRACT

In a vehicle door handle system, a handle is pivotally supported by a base member, at least one portion of the base member being attached to an outer panel; and a lever member is pivotally supported by a spindle fixed to the base member and having an axis at a right angle to a plane extending along the outer panel, the lever member being interlocked and connected with a handle arm configured to pivot with the handle and the lever member being linked to a latch device. An attachment part which attaches the base member to the outer panel is disposed coaxially with the spindle. Accordingly, it is possible to attach the base member to the outer panel while avoiding the bulkiness of conventional systems.

17 Claims, 10 Drawing Sheets

(56) References Cited

U.S. PATENT DOCUMENTS

| | | | | |
|---|---|---|---|---|
| 5,450,735 | A * | 9/1995 | Esaki et al. | 70/208 |
| 5,560,659 | A * | 10/1996 | Dault | 292/336.3 |
| 5,630,630 | A * | 5/1997 | Price et al. | 292/128 |
| 5,743,575 | A * | 4/1998 | McFarland | 292/336.3 |
| 5,860,684 | A * | 1/1999 | Mizuki | 292/336.3 |
| 6,007,122 | A * | 12/1999 | Linder et al. | 292/336.3 |
| 6,073,397 | A * | 6/2000 | Tanimoto et al. | 49/460 |
| 6,108,979 | A * | 8/2000 | Saffran et al. | 49/503 |
| 6,167,779 | B1 * | 1/2001 | Sano et al. | 74/543 |
| 6,264,254 | B1 * | 7/2001 | Siegfried et al. | 292/336.3 |
| 6,363,577 | B1 * | 4/2002 | Spitzley | 292/336.3 |
| 6,464,270 | B1 * | 10/2002 | Sloan et al. | 292/336.3 |
| 6,523,869 | B1 * | 2/2003 | Jensen et al. | 292/336.3 |
| 6,565,134 | B1 * | 5/2003 | Stuart et al. | 292/336.3 |
| 6,913,297 | B2 * | 7/2005 | Jackson et al. | 292/196 |
| 6,973,810 | B2 * | 12/2005 | Chen | 70/208 |
| 7,066,506 | B2 * | 6/2006 | Pudney | 292/336.3 |
| 7,146,832 | B2 * | 12/2006 | Mathofer | 70/208 |
| 7,237,411 | B2 * | 7/2007 | Pantke et al. | 70/208 |
| 7,341,291 | B2 * | 3/2008 | Ooe et al. | 292/336.3 |
| 7,343,646 | B2 | 3/2008 | Hayashi | |
| 7,360,808 | B2 * | 4/2008 | Odahara et al. | 292/336.3 |
| 7,431,357 | B2 * | 10/2008 | Pudney | 292/336.3 |
| 7,497,488 | B2 * | 3/2009 | Chen | 292/216 |
| 8,162,360 | B2 * | 4/2012 | Takaya et al. | 292/336.3 |
| 8,469,411 | B2 * | 6/2013 | Costigan | 292/336.3 |
| 8,579,339 | B2 * | 11/2013 | Abe | 292/336.3 |
| 2003/0177796 | A1 * | 9/2003 | Dimig | 70/237 |
| 2009/0256366 | A1 * | 10/2009 | Abe | 292/336.3 |

FOREIGN PATENT DOCUMENTS

| | | | |
|---|---|---|---|
| JP | 62-196465 | U | 12/1987 |
| JP | 1-100871 | U | 7/1989 |
| JP | 5-32643 | U | 4/1993 |
| JP | 06-035549 | U | 5/1994 |
| JP | 2000-045579 | A | 2/2000 |
| JP | 2000-274129 | A | 10/2000 |
| JP | 2005-207546 | A | 8/2005 |
| JP | 2006-176969 | A | 7/2006 |
| JP | 2007-085136 | A | 4/2007 |
| JP | 2007-126867 | A | 5/2007 |
| JP | 2007-132107 | A | 5/2007 |
| JP | 2007-327272 | A | 12/2007 |
| JP | 2008-121358 | A | 5/2008 |

* cited by examiner

VEHICLE DOOR HANDLE SYSTEM

CROSS-REFERENCE TO RELATED APPLICATIONS

The present application claims priority under 35 USC §119 based on Japanese Patent Application Nos. 2010-016603 and 2010-016604, both filed 28 Jan. 2010. The subject matter of these priority documents is incorporated herein by reference.

BACKGROUND OF THE INVENTION

1. Field of the Invention

The present invention relates to a vehicle door handle system in which a handle is pivotally supported by a base member, at least one portion of which is attached to an outer panel of a vehicle door, and a lever member is pivotally supported by a spindle fixed to the base member and having an axis at a right angle to a plane extending along the outer panel. The lever member is interlocked and connected with a handle arm configured to pivot with the handle and is linked to a latch device.

2. Description of the Related Art

Japanese Utility Model Application Laid-open No. 6-35549 has made known a vehicle door handle system in which a base member is attached to an outer panel at two portions, and a handle arm, installed continuously to a handle pivotally supported by the base member, is interlocked and connected with a lever member which is pivotally supported by a spindle fixed to the base member and which is linked to a latch device.

However, in the vehicle door handle system disclosed in Japanese Utility Model Application Laid-open No. 6-35549, for the purpose of avoiding interference with the lever member configured to pivot about the axis of the spindle fixed to the base member, the base member is attached to two portions of the outer panel which are spaced away from the lever member. Due to this arrangement, a larger space is required for providing the attachment parts for the base member, whereby the vehicle door handle system becomes bulky.

SUMMARY OF THE INVENTION

The present invention has been made with this condition taken into consideration. An object of the present invention is to provide a vehicle door handle system which enables a base member to be attached to an outer panel, and which is compact in size.

In order to achieve the object, according to a first aspect and feature of the present invention, there is provided a vehicle door handle system comprising: a handle pivotally supported by a base member, at least one portion of the base member being attached to an outer panel of a vehicle door; and a lever member pivotally supported by a spindle fixed to the base member and having an axis substantially at a right angle to a plane extending along the outer panel, the lever member being interlocked and connected with a handle arm configured to pivot with the handle, the lever member being linked to a latch device, and wherein an attachment part which attaches the base member to the outer panel is disposed coaxially with the spindle.

According to the configuration of the first aspect and feature of the present invention, even if multiple portions of the base member are attached to the outer panel, no space need be secured in a place away from the lever member for any such portion. Accordingly, it is possible compactly construct the door handle system with a smaller size.

According to a second aspect and feature of the present invention, in addition to the first aspect and feature, the attachment part comprises: an attached surface formed in an end portion of the spindle on a side opposite from the base member; and a bolt having an expanded-diameter head part and coaxially screwed to the spindle, the expanded-diameter head part interposing a reinforcement plate between the attached surface and the expanded-diameter head part, the reinforcement plate being fixedly attached to the outer panel.

According to the configuration of the second aspect and feature of the present invention, the reinforcement plate is interposed between the attachment part and the outer panel. Accordingly, while the handle is operated, it is possible to disperse a force which is applied to the outer panel, and to prevent the outer panel from deforming. In addition, an end portion of the spindle, on a side opposite from the base member, is supported by the outer panel with the reinforcement plate interposed in between. For this reason, the supporting structure for the spindle is configured as a structure in which the spindle is supported at its two ends. Accordingly, it is possible to ensure that the spindle has enough strength to bear a force which is applied to the spindle when the lever member pivots.

According to a third aspect and feature of the present invention, in addition to the first or second aspect and feature, the spindle is fixed to a support plate attached to the base member made of a synthetic resin and the spindle is a body separated from the base member.

According to the configuration of the third aspect and feature of the present invention, the spindle, whose diameter is relatively large for supporting the lever member, is not formed or molded integrally with the base member, so that no consideration need be taken to shrinkage and the like which may occur on the surface of the base member. It is thus easy to mold the appearance of the base member.

According to a fourth aspect and feature of the present invention, in addition to the first aspect and feature, in order to pivot in response to rotation of the handle, the lever member is provided with an abutment surface abutting on the handle arm, and when the lever member pivots to a rotation position for bringing the latch device into an unlatched condition, a contact portion of the handle arm contacting with the abutment surface is set to be situated on a plane which includes an axis of the spindle, and which is substantially parallel to a rotational axis of the handle arm.

According to the configuration of the fourth aspect and feature of the present invention, the size of the abutment surface needed to ensure that the abutment surface is always in abutment on the pivotable handle arm can be set smaller. Accordingly, it is possible to construct the door handle system in a smaller size.

According to a fifth aspect and feature of the present invention, in addition to the first aspect and feature, the handle arm extends continuously from the handle disposed in an external surface of the door and is pivotally supported by the base member by use of a pivotally-supporting pin, and a counterweight attached to the handle arm integrally includes: a weight part which extends in a direction intersecting the handle arm; and a reinforcement part which extends continuously from the weight part in a direction along the handle arm and is in surface contact with the handle arm.

According to the configuration of the fifth aspect and feature of the present invention, the reinforcement part constituting part of the counterweight extends continuously from the weight part in a direction along the handle arm, and is in surface contact with the handle arm. For this reason, it is possible to disperse a load which the counterweight exerts on the handle arm. Accordingly, the thickness of the handle arm need not be made large, and it is thus possible to avoid the bulkiness of conventional door handle systems.

According to a sixth aspect and feature of the present invention, in addition to the fifth aspect and feature, the handle arm integrally includes an arm part and a lever part, the arm part having an end which extends continuously from the handle toward an inside of the door and includes a spindle hole provided in an opposite end portion thereof, the lever part extending in a direction substantially orthogonal to a longitudinal direction of the arm part, one end portion of the lever part extending continuously from the opposite end portion of the arm part, an opposite end portion of the lever part being interlocked and connected with the latch device, the pivotally-supporting pin is inserted in the spindle hole, the counterweight is attached to the one end portion of the lever part, and the reinforcement part of the counterweight is formed extending along the lever part in a direction extending away from the opposite end portion of the arm part.

According to the configuration of the sixth aspect and feature of the present invention, an attachment part in which the counterweight is attached to the handle arm is located in the vicinity of the pivotally-supporting part of the handle arm. Thereby, it is possible to increase the strength of the attachment part in which the counterweight is attached to the handle arm without making the thickness of the handle arm larger. Furthermore, it is possible to increase the rigidity of the lever member by reinforcing the lever member interlocked and connected with the latch device with the reinforcement part extending along the lever member in the direction extending away from the opposite end portion of the arm part. Accordingly, it is possible to make the total weight of the counterweight relatively lighter.

According to a seventh aspect and feature of the present invention, in addition to the fifth or sixth aspect and feature, the reinforcement part extends continuously from one end portion of the weight part extending in a direction parallel to a pivot axis of the handle arm, and an extension part which extends in a direction orthogonal to the pivot axis of the handle arm extends integrally and continuously from an opposite end portion of the weight part.

According to the configuration of the seventh aspect and feature of the present invention, it is possible to inhibit the center of gravity of the counterweight from shifting to one side of the weight part in its longitudinal direction.

According to an eighth aspect and feature of the present invention, in addition to the seventh aspect and feature, the extension part is disposed in a position close to and opposed to one end of the pivotally-supporting pin.

According to the configuration of the eighth aspect and feature of the present invention, the extension part of the counterweight is located close to and opposed to the one end of the pivotally-supporting pin, and thus is able to block the pivotally-supporting pin from coming out of position. Accordingly, a specialized part for preventing the pivotally-supporting pin from coming out of position is no longer necessary, and it is possible to reduce the number of parts and the number of assembling steps. Furthermore, no engagement part configured to engage with the base member side for blocking the pivotally-supporting pin from coming out of position need be formed in the pivotally-supporting pin. For this reason, it is possible to contribute to constructing the door handle system in a smaller size by reducing the length and size of the pivotally-supporting pin to a minimum.

According to a ninth aspect and feature of the present invention, in addition to the fifth aspect and feature, a first handle arm to which the counterweight is attached and a second handle arm which is disposed spaced apart from the first handle arm extend continuously from the handle, paired brackets for supporting the first and second handle arms in a way that the first and second handle arms are pivotable, are provided to the base member in a way to be opposed to and in abutment with the first and second handle arms from outer sides thereof, and the weight part is integrally provided with reception parts which abut on the first and second handle arms from inner side thereof.

According to the configuration of the ninth aspect and feature, the movement of the two handle arms in the direction of the rotational axis is inhibited, and the space between the two handle arms is maintained by the reception parts of the counterweight. Accordingly, it is possible to prevent any loosening of the two handle arms.

According to a tenth aspect and feature of the present invention, in addition to the fifth aspect and feature, the lever member linked to the latch device and rotating about an axis orthogonal to a plane including a rotational axis of the handle in response to rotational operation of the handle is supported by the base member in a way that part of the lever member overlaps the counterweight during its rotation, and the counterweight is provided with an escape groove for avoiding interference with the lever member.

According to the configuration of the tenth aspect and feature, the counterweight can be disposed closer to the lever member, and it is possible to contribute to constructing the door handle system in a smaller size.

Here, a first handle arm 16 of the exemplary embodiment corresponds to the handle arm of the present invention; and a first attachment part 42 of the exemplary embodiment corresponds to the attachment part of the present invention.

The above description, other objects, characteristics and advantages of the present invention will be clear from detailed descriptions which will be provided for the preferred embodiment referring to the attached drawings.

DESCRIPTION OF THE PRESENT EXEMPLARY EMBODIMENT

Figure 1:
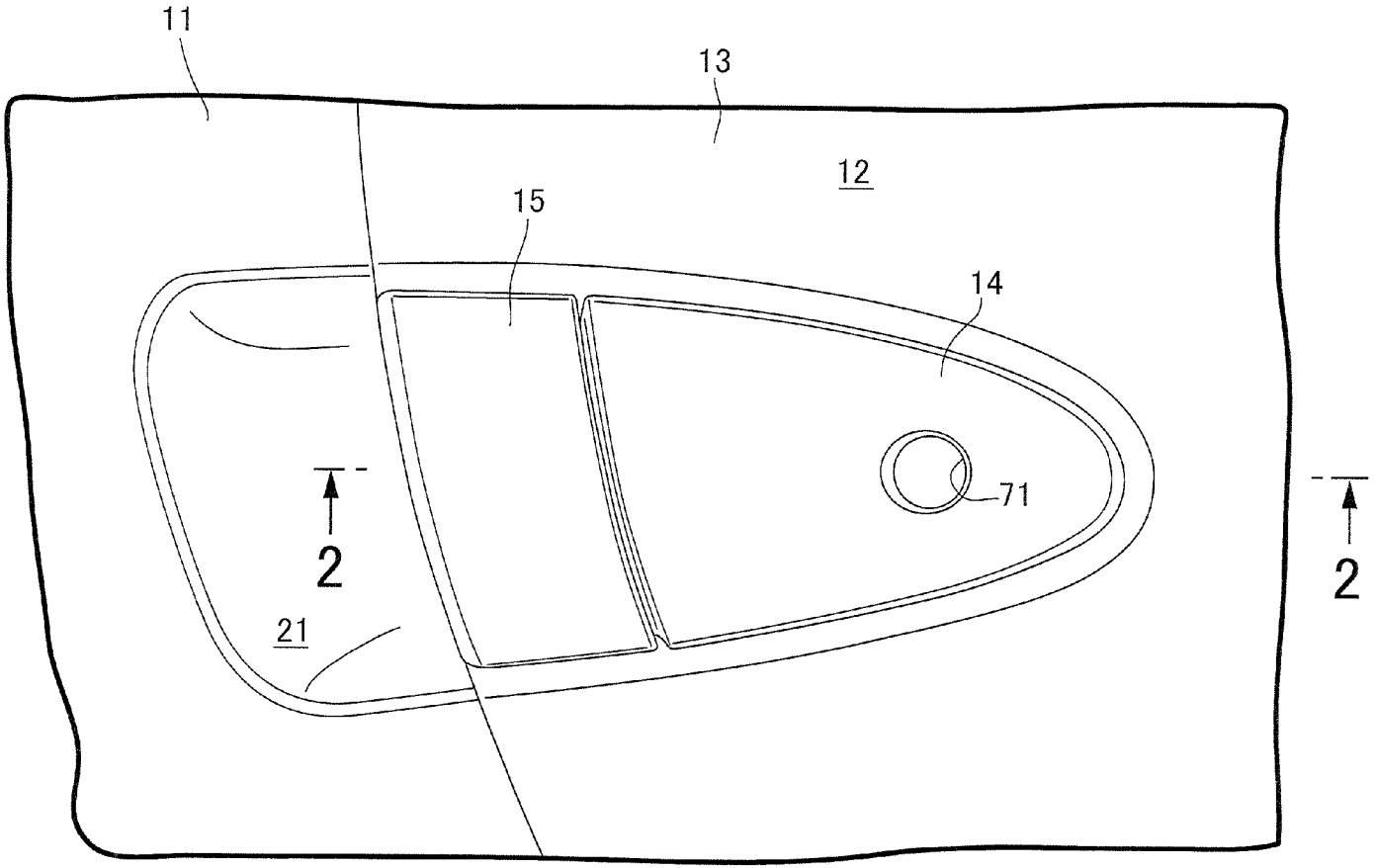
FIG. 1 is a side view showing a part of a vehicle door according to the present invention.

Hereinafter, an exemplary embodiment of the present invention will be described with reference to FIGS. 1 to 10 attached herein. First, in FIGS. 1 and 2, for example, a door 12 which is a side door is openably and closably attached to a vehicle body 11 of a passenger vehicle. A base member 14 made of a synthetic resin is fixed to an outer panel 13 of this door 12. A synthetic resin-made handle 15 pivotally supported by the base member 14 is disposed in the external surface of the door 12, namely the outer surface of the outer panel 13.

An attachment depressed part 19 provided with an opening part 18 in its middle portion is formed in the rear portion of the outer panel 13. The base member 14 formed extending long in the frontward-rearward direction of the vehicle is disposed in the attachment depressed part 19, and is fixed to the rear portion of the outer panel 13. The opening part 18 is closed by the base member 14. Furthermore, the rear portion of the base member 14 is integrally provided with a support plate part 14*a* for forming an insertion depressed part 20 in cooperation with both of the front portion of the base member 14 and the upper and lower sides of the rear portion of the attachment depressed part 19. In addition, a depressed part 21 which continues to the insertion depressed part 20 when the door 12 is closed is provided to the vehicle body 11. The handle 15 distending outward, whose lateral cross-sectional form is shaped like an arc, is disposed in the insertion depressed part 20 in a way that an opening operation can be carried out with a hand inserted in the depressed part 21 in the vehicle body 11.

Figure 3:
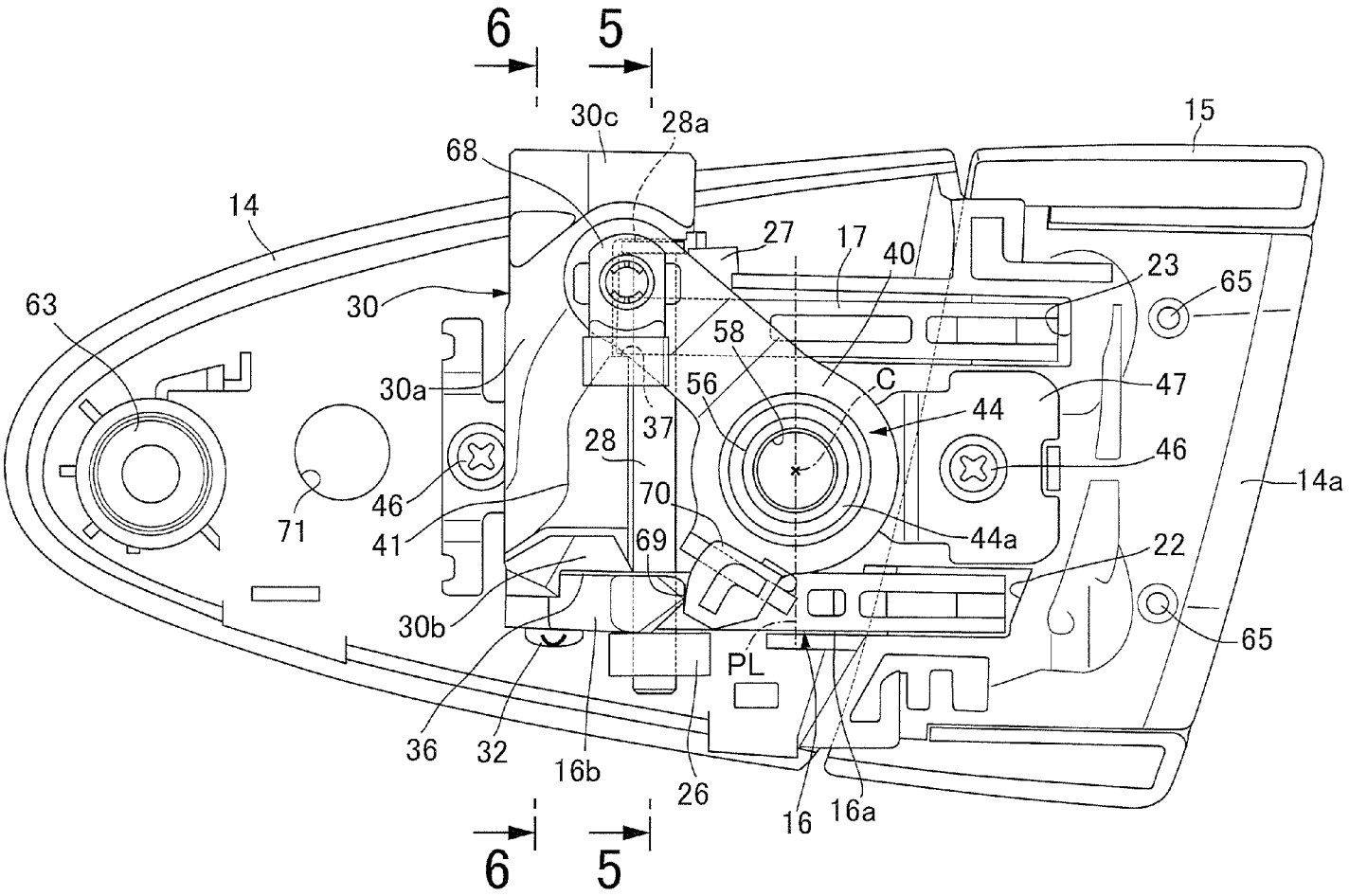
FIG. 3 is a view seen from a direction of an arrow 3 in FIG. 2, with a reinforcement plate being omitted, during a period when a handle is not operated.
Figure 4:
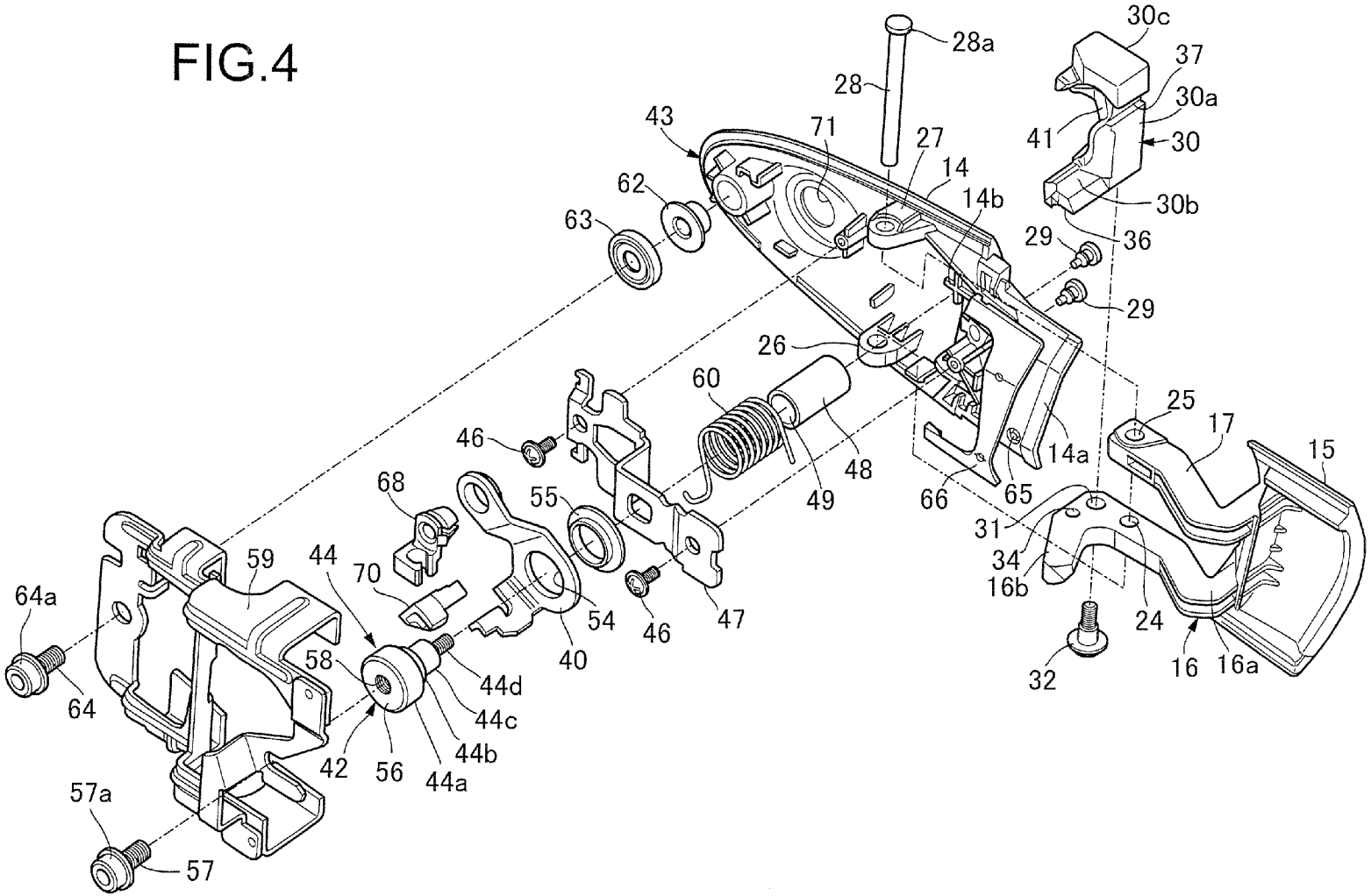
FIG. 4 is an exploded perspective view of a door handle system according to the present invention.

Referring now to FIGS. 3 and 4, first and second handle arms 16, 17 extend integrally and continuously from the handle 15. The first handle arm 16 extends integrally and continuously with the inner surface of the lower portion of the handle 15. The first handle arm 16 is inserted into the inside of the door 12 though a lower insertion hole 22 provided in the support plate part 14*a* of the base member 14. In addition, the second handle arm 17 extends integrally and continuously with the inner surface of the upper portion of the handle 15 over the first handle arm 16. The second handle arm 17 is inserted into the inside of the door 12 through an upper insertion hole 23 provided in the support plate part 14*a* of the base member 14 over the lower insertion hole 22.

The first handle arm 16 is formed by integrally including an arm part 16*a* and a lever part 16*b*. The middle portion of the arm part 16*a* is bent substantially in the form of the letter L. One end of the arm part 16*a* extends continuously from the inner surface of the lower portion of the handle 15. The arm part 16*a* extends toward the inside of the door 12 after penetrating the lower insertion hole 22. One end of the lever part 16*b* extends continuously from the opposite end portion of the arm part 16*a*. A spindle hole 24 is provided in the opposite end portion of the arm part 16*a*. The arm part 16*a* extends continuously from the inner surface of the lower portion of the handle 15 in a way that the longitudinal direction of the arm part 16*a* is made to be along the frontward-rearward direction of the vehicle when the handle 15 is not operated. The lever part 16*b* extends continuously from the opposite end portion of the arm part 16*a* such that it extends in a direction which is substantially orthogonal to the longitudinal direction of the arm part 16*a*, and which goes away from the base member 14 when the handle 15 is not operated. Furthermore, the opposite end portion of the lever part 16*b* is interlocked and connected with a latch device (not illustrated) provided to the door 12 in a way that the latched condition, in which the door 12 is kept closed, and the unlatched condition, in which the door 12 can be opened, can be switched back and forth.

Moreover, the second handle arm 17 is formed in a way that: the middle portion of the second handle arm 17 is bent substantially in the form of the letter L; and one end of the second handle arm 17 extends continuously from the inner surface of the upper portion of the handle 15; and the second handle arm 17 extends toward the inside of the door 12 after penetrating the upper insertion hole 23. The opposite end portion of this second handle arm 17 is provided with a spindle hole 25 coaxial with the spindle hole 24 provided in the opposite end portion of the arm part 16*a* of the first handle arm 16. Further, the opposite end portion of the second handle arm 17 and the opposite end portion of the arm part 16*a* of the first handle arm 16 are located in substantially the same position in the frontward-rearward direction of the vehicle.

Figure 5:
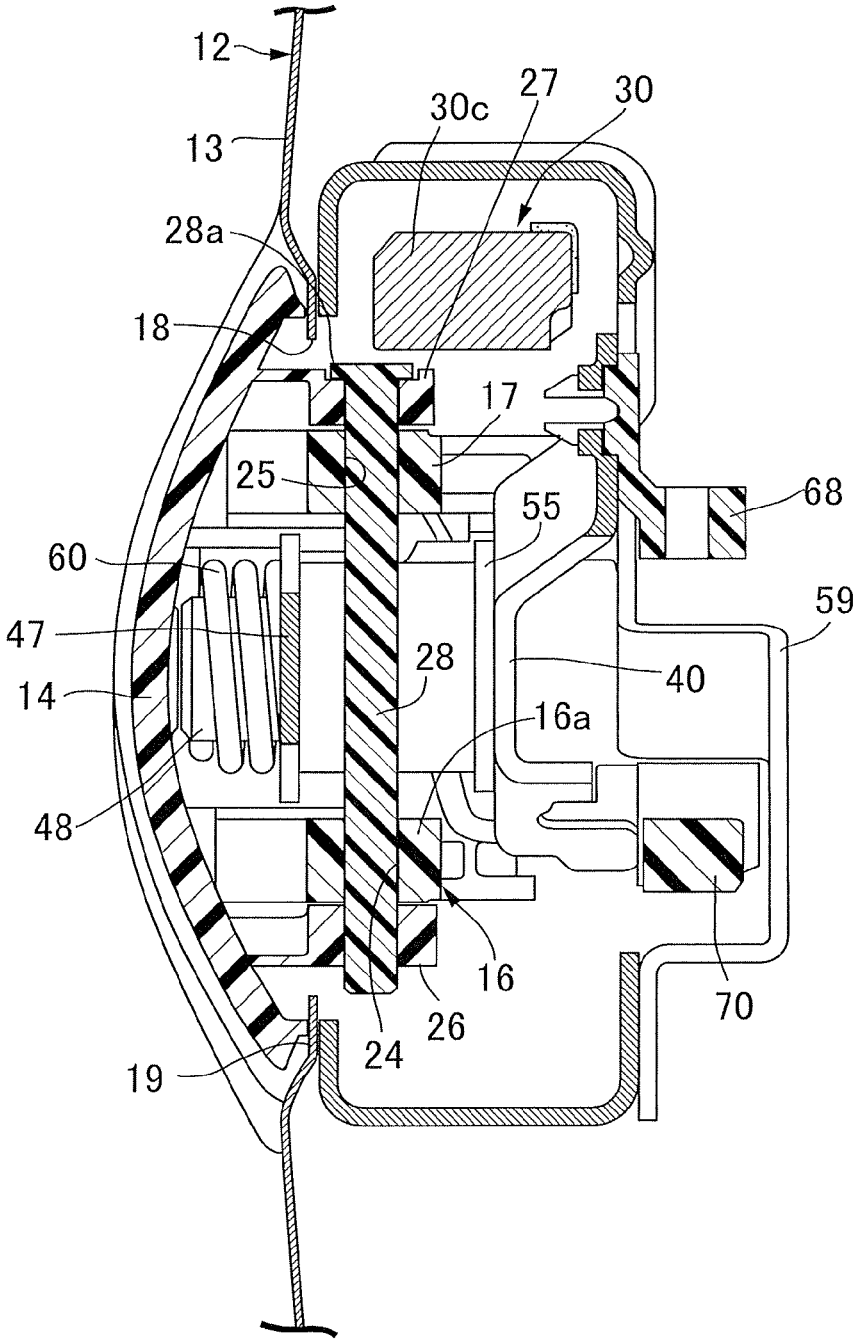
FIG. 5 is a sectional view taken along a line 5-5 in FIG. 3.

Referring now to FIG. 5, paired brackets 26, 27 are integrally provided on the inner surface of the middle portion of the base member 14 extending in the frontward-rearward direction of the vehicle. The paired brackets 26, 27 are positioned opposite each other and in abutment with the end portion of the arm part 16*a* of the first handle arm 16 and the end portion of the second handle arm 17 on the outside, respectively. The first and second handle arms 16, 17, namely the handle 15, are pivotally supported by the brackets 26, 27 by use of a pivotally-supporting pin 28 inserted in the spindle holes 24, 25. In addition, paired stoppers 29 (see FIG. 4) each made of an elastic material are attached to the support plate part 14*a* of the base member 14. The paired stoppers 29 are in abutment with the handle 15 when the handle 15 is not operated.

An expanded-diameter part 28*a* is provided in one end of the pivotally-supporting pin 28. Of the two brackets 26, 27, the expanded-diameter part 28*a* can abut and engage the upper bracket 27 from the above. From the upper bracket 27 side of the two brackets 26, 27, the pivotally-supporting pin 28 is sequentially inserted into the bracket 27, the spindle hole 25 of the second handle arm 17, the spindle hole 24 of the arm part 16*a* of the first handle arm 16, and the bracket 26. The opposite end of the pivotally-supporting pin 28 juts out downward from the lower bracket 26 with the expanded-diameter part 28*a* abutting and engaging the upper bracket 27.

Figure 6:
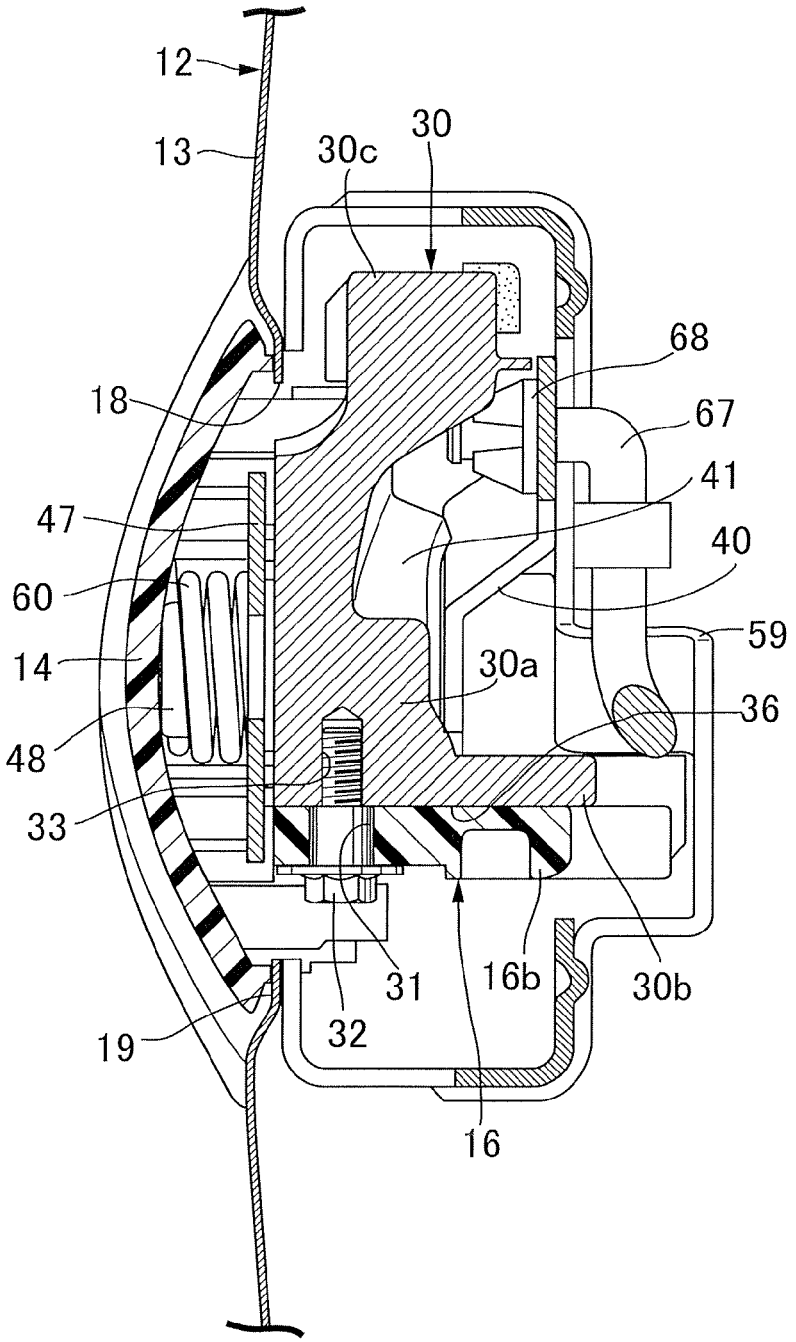
FIG. 6 is a sectional view taken along a line 6-6 in FIG. 3.
Figure 7:
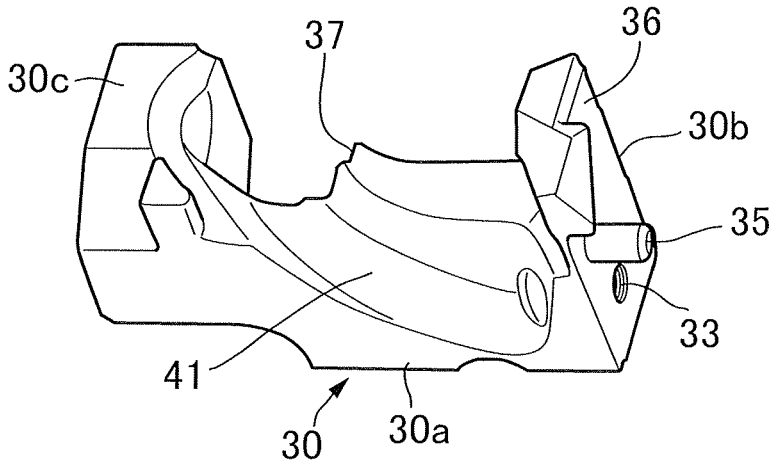
FIG. 7 is a perspective view of a counterweight according to the present invention.

Referring to FIGS. 6 and 7, a counterweight 30 is attached to the first handle arm 16. This counterweight 30 integrally includes a weight part 30*a*, a reinforcement part 30*b*, and an extension part 30*c*. The weight part 30*a* extends in a direction intersecting the first and second handle arms 16, 17, and parallel to the rotational axes of the first and second handle arms 16, 17, i.e., the axis of the pivotally-supporting pin 28. The reinforcement part 30*b* extends along the first handle arm 16, extends integrally from and continuously along one end portion of the weight part 30*a*, and is in surface contact with the first handle arm 16. The extension part 30*c* extends continuously from the opposite end portion of the weight part 30*a*, and extends in a direction orthogonal to the rotational axes of the first and second handle arms 16, 17.

In addition, the counterweight 30 is formed in a way that the cross-sectional area of the counterweight 30 on a plane orthogonal to the rotational axes of the first and second handle arms 16, 17 is larger in the reinforcement part 30*b* and the extension part 30*c* than in the weight part 30*a*. In other words, the counterweight 30 is formed in a way that the thickness of the weight part 30*a* in the frontward-rearward direction of the vehicle is as thin as possible.

The counterweight 30 is attached to the inner side surface of the one end portion of the lever part 16*b* of the first handle arm 16. The one end of the weight part 30*a* is provided with a closed-end screw hole 33 into which to screw a stepped bolt 32 which is to be screwed into a bolt insertion hole 31 provided in the one end portion of the lever part 16*b* and disposed in the vicinity of the spindle hole 24. In addition, a positioning pin 35 is integrally provided in the one end of the weight part 30*a* in a projecting manner. The positioning pin 35 is inserted in a positioning hole 34 provided in the one end portion of the lever part 16*b* of the first handle arm 16, and the positioning hole 34 being in the vicinity of the spindle hole 24 and the bolt insertion hole 31. The opposite end portion of the weight part 30*a* which has the one end portion attached to the one end portion of the lever part 16*b* and which extends parallel to the axis of the pivotally-supporting pin 28 passes in front of the second handle arm 17, and extends out beyond the second handle arm 17.

The reinforcement part 30*b* is formed extending along the lever part 16*b* of the first handle arm 16 in a direction which goes away from the opposite end portion of the arm part 16*a*. The reinforcement part 30*b* is in surface contact with the inner side surface of the lever part 16*b* of the first handle arm 16. In addition, the extension part 30*c* is formed extending in a direction orthogonal to the rotational axes of the first and second handle arms 16, 17, namely, the axis of the pivotally-supporting pin 28. The extension part 30*c* is disposed in a position close to and opposed to the expanded-diameter part 28*a* of one end of the pivotally-supporting pin 28 from the outer side thereof.

Furthermore, the weight part 30*a* of the counterweight 30 is integrally provided with reception parts 36, 37 in abutment on the first and second handle arms 16, 17, respectively, from the inner sides thereof. The reception part 36 is formed as a flat surface and is one end surface of the weight part 30*a*, and abuts the inner side surface of the lever part 16*b* of the first handle arm 16. The other reception part 37 is in abutment with the inner side surface of the opposite end portion of the second handle arm 17.

Meanwhile, the lever member 40 is supported by the base member 14 in a way that, when the lever member 40 pivots, part of the lever member 40 overlaps the counterweight 30. The lever member 40 links to the latch device, and pivots about an axis orthogonal to a plane including the rotational axis of the handle 15 in response to the rotational operation of the handle 15. The weight part 30*a* of the counterweight 30 is provided with an escape groove 41 for avoiding interference with the lever member 40.

At least one part of the base member 14 is attached to the outer panel 13 of the door 12 by use of an attachment part. In this exemplary embodiment, the middle portion of the base member 14 extending in the frontward-rearward direction of the vehicle is attached to the outer panel 13 by use of a first attachment part 42. The front portion of the base member 14 extending in the frontward-rearward direction of the vehicle is attached to the outer panel 13 by use of a second attachment part 43.

On the inner side of the middle portion of the base member 14 extending in the frontward-rearward direction of the vehicle, between the first and second handle arms 16, 17, a spindle 44 is disposed so that it supports the lever member 40 in such a way that the lever member 40 is pivotable. The spindle 44 has its axis C substantially orthogonal to a plane extending along the outer panel 13. This spindle 44 is fixed to the base member 14.

The counterweight 30 including the weight part 30*a* extending parallel to the rotational axes of the first and second handle arms 16, 17 is fixed to the first handle arm 16. The spindle 44 is disposed in the vicinity of the weight part 30*a* in the rear of the weight part 30*a* in the frontward-rearward direction of the vehicle. Because the counterweight 30 is formed in a way that the thickness of the weight part 30*a* in the frontward-rearward direction of the vehicle is as thin as possible, the counterweight 30 can be situated closer to the spindle 44 while avoiding its interference therewith. Thereby, it is possible to construct the door handle system as a whole in a compact size.

The spindle 44 is formed by coaxially aligning a large-diameter part 44*a*, a medium-diameter part 44*b* which is smaller in diameter than the large-diameter 44*a*, a small-diameter part 44*c* which is smaller in diameter than the medium-diameter 44*b*, a screw shaft part 44*d* which is smaller in diameter than the small-diameter part 44*c*, sequentially from a side of the spindle 44 which is opposite from the base member 14. The spindle 44 is a body separated from the base member 14 made of a synthetic resin.

While being positioned, a support plate 47 is attached to the inner surface of the base member 14 by multiple screw members, for example, paired screw members 46. The spindle 44 is fixed to this support plate 47. Specifically, one end of a bar-shaped support member 48 abuts on the support plate 47 at a position corresponding to the spindle 44. The support plate 47 has a fitting hole (not numbered) and the support member 48 has a fitting hole 49 into which the small-diameter part 44*c* of the spindle 44 is fitted. The support member 48 is provided with a close-end screw hole 50 into which the screw shaft part 44*d* is screwed in a way so as to be aligned with the fitting holes coaxially. When the screw shaft part 44*d* is screwed and fastened to the screw hole 50 with the small-diameter part 44*c* of the spindle 44 fitted into the fitting hole 49, the spindle 44 and the support member 48 are fixed to the support plate 47 with the support plate 47 interposed in between, and thus the spindle 44 is fixed to the base member 14 with the support plate 47 interposed in between.

Meanwhile, corresponding to the support member 48, a projecting part 14*b* is integrally provided with the inner surface of the base member 14 in a projecting manner. A tool engagement depressed part 51 is provided in the opposite end portion of the support member 48 from the support plate 47. A tool such as a screw driver can be inserted into and engaged with the tool engagement depressed part 51 when the screw shaft part 44*d* is screwed and fastened to the screw hole 50, e.g., for preventing the support member from rotating.

The lever member 40 is provided with a support hole 54 into which the medium-diameter part 44*b* of the spindle 44 is inserted. The medium-diameter part 44*b* and a synthetic resin-made washer 55 interposed between the support plate 47 and the lever member 40 are attached to the support hole 54. Accordingly, the lever member 40 and the washer 55 are interposed between an annular stepped part 44*e* and the support plate 47. The annular stepped part 44*e* is formed between the large-diameter part 44*a* and the medium-diameter 44*b* of the spindle 44. The lever member 40 is pivotally supported by the spindle 44 with the washer 55 interposed in between, the spindle 44 fixed to the base member 14 with the support plate 47 interposed in between.

The first attachment part 42 is disposed coaxially with the spindle 44. The first attachment part 42 includes: an attached surface 56 which is formed in an end portion of the spindle 44 on a side opposite from the base member 14; a bolt 57 having an expanded-diameter head part 57*a* and coaxially screwed to the spindle 44. Also, a reinforcement plate 59 fixedly attached to the outer panel 13 is interposed between the expanded-diameter head part 57*a* and the attached surface 56, and the spindle 44 is coaxially provided with a closed-end screw hole 58 into which the bolt 57 is screwed.

A return spring 60 is provided between the lever member 40 and the base member 14. The return spring 60 is configured to pivotally bias the first handle arm 16 with which the lever member 40 is interlocked and connected, that is to say, the handle 15, to a non-operation position. This return spring 60 is a twisted or coil spring whose one end is engaged with the lever member 40, and which surrounds the support member 48 and the projecting part 14*b*. The opposite end portion of this return spring 60 is engaged with the base member 14.

Figure 8:
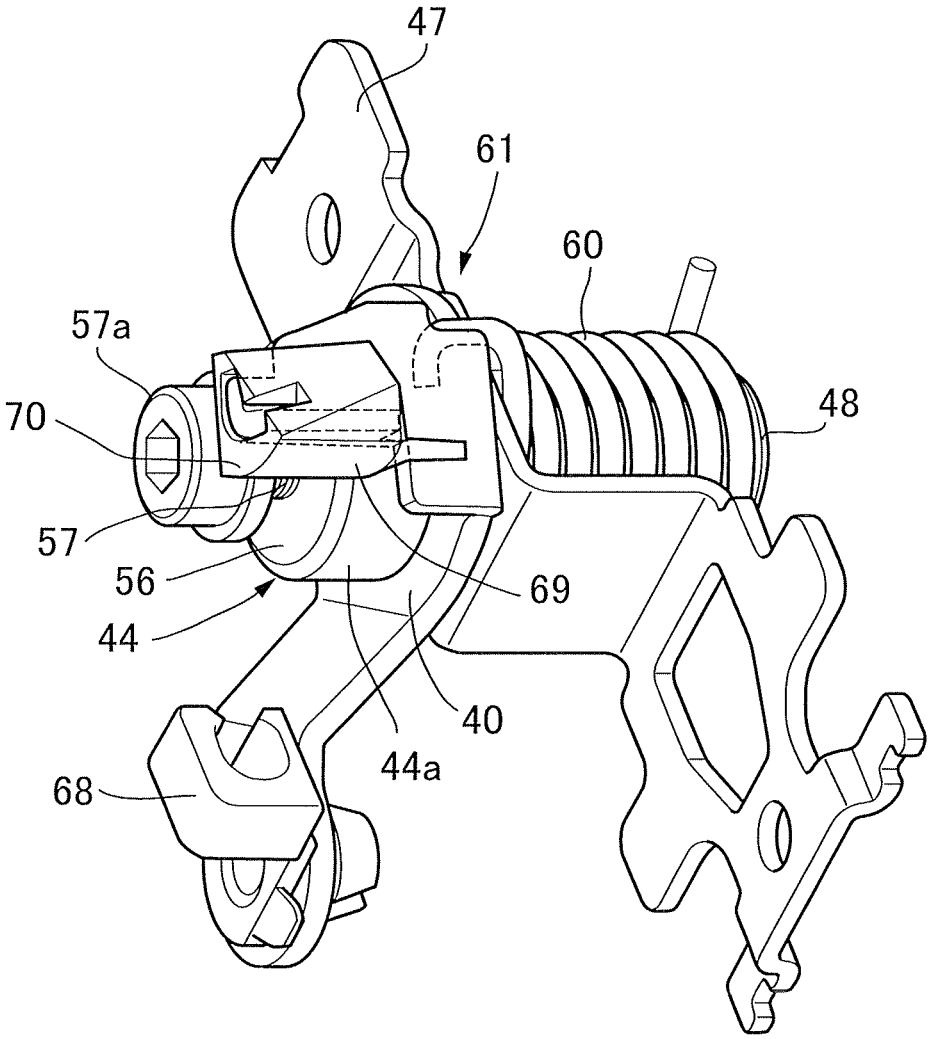
FIG. 8 is a perspective view of a lever member assembly unit according to the present invention.

Meanwhile, the spindle 44 and the support member 48 which are bodies separated from the base member 14, are fixed to the support plate 47 attached to the base member 14, the lever member 40 is pivotally supported by the spindle 44, and the one end portion of the return spring 60 surrounding the support member 48 is engaged with the lever member 40. For these reasons, as shown in FIG. 8, the support member 48, the support plate 47, the spindle 44, the lever member 40, and the return spring 60 can be sub-assembled together as a lever member assembly unit 61 in advance. The attaching of this lever member assembly unit 61 to the base member 14 leads to the enhancement of the workability and efficiency for the attachment.

Figure 2:
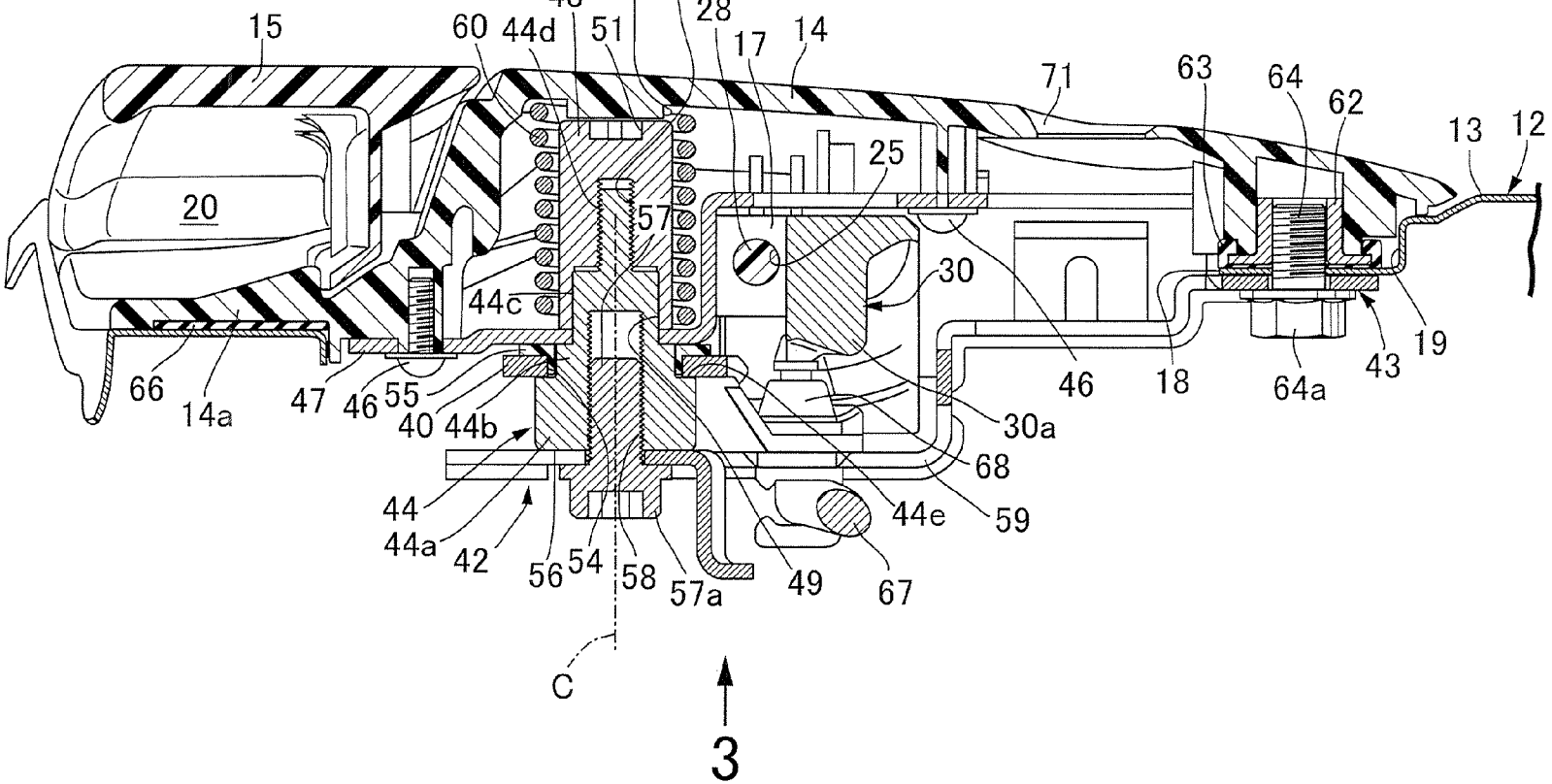
FIG. 2 is an enlarged sectional view taken along a line 2-2 in FIG. 1.

Turning attention to FIGS. 2 to 4, the second attachment part 43 includes: a nut 62 inserted in and connected to the frontward portion of the base member 14 extending in the frontward-rearward direction of the vehicle; an elastic member 63 attached to the nut 62; and a bolt 64 screwed into the nut 62. The outer panel 13 and the reinforcement plate 59, through which the bolt 64 penetrates, are interposed between an expanded-diameter head part 64*a* of the bolt 64 and the elastic member 63. Thereby, the base member 14 is attached to the outer panel 13 by use of the second attachment part 43, and the reinforcement plate 59 is fixed to the outer panel 13 and the base member 14.

Furthermore, for example, two fitting protrusions 65 (see FIGS. 3 and 4) are projectingly provided on a surface of the support plate part 14*a* of the base member 14 on a side closer to the outer panel 13. A flat plate-shaped elastic member 66 is attached to the surface of the support plate part 14*a* on the side closer to the outer panel 13 by fitting these fitting protrusions 65 to the elastic member 66. This elastic member 66 is interposed between the support plate part 14*a* and the outer panel 13.

The lever member 40 is formed in a substantially L-shape. A rod connection member 68 is attached to one end portion of this lever part 40. To the rod connection member 68, one end portion of a rod 67 (see FIGS. 2 and 6) is connected. The rod 67 is configured to transmit an operating force to the latch device. The escape groove 41 in the counterweight 30 is formed of an arc-shape in order that any interference with the rod connection member 68 in conjunction with the rotation of the lever member 40 can be avoided.

Moreover, an abutment member 70 is attached to the opposite end portion of the lever member 40. The abutment member 70 is made of an elastic material, and includes an abutment surface 69 on which the opposite end of the lever part 16*b* of the first handle arm 16 is in abutment. The abutment surface 69 is formed as an arc surface slightly distending toward the opposite end of the lever part 16*b*.

Figure 9:
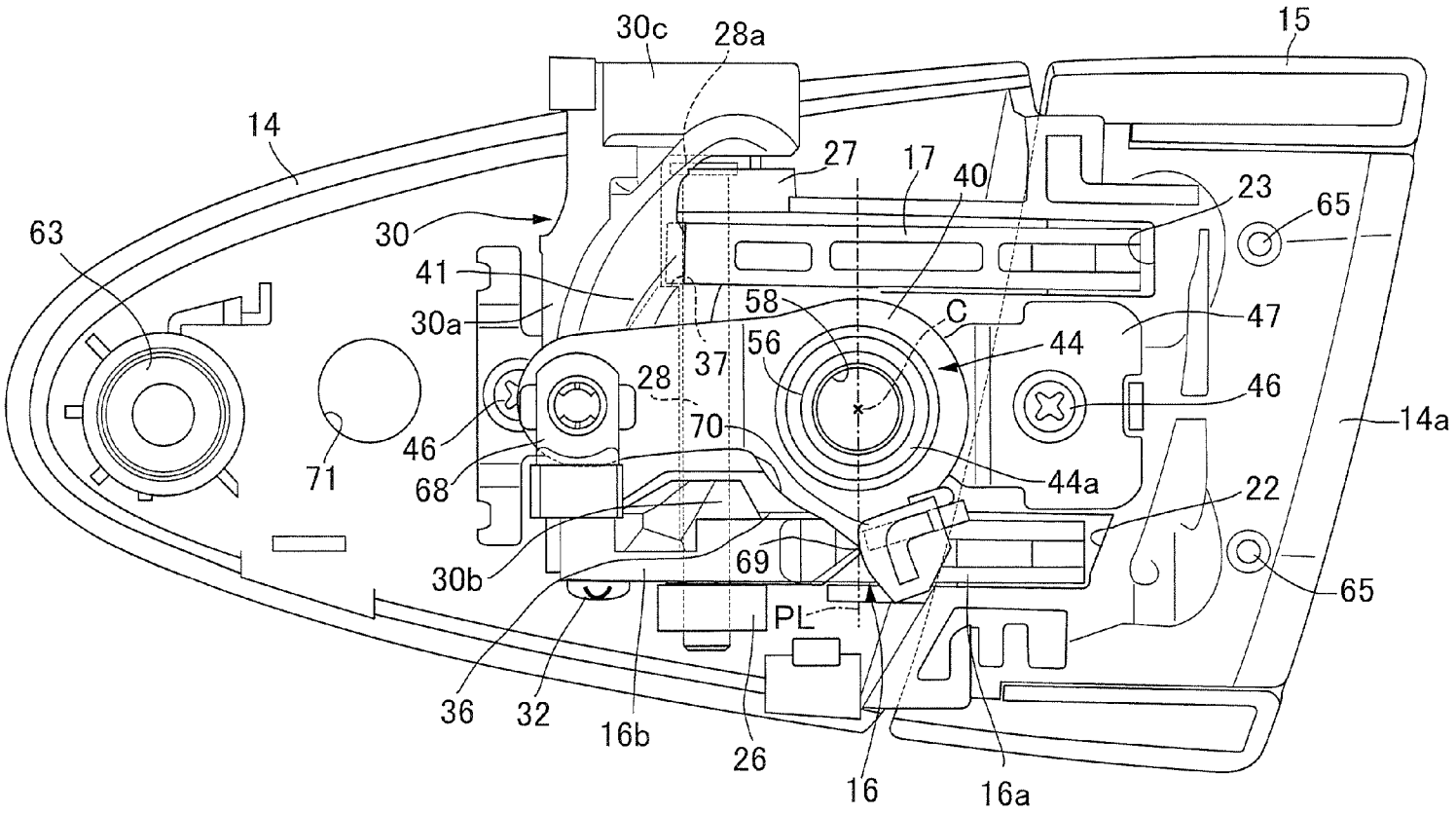
FIG. 9 is a view corresponding to FIG. 3, with the reinforcement plate being omitted, and in a case where the handle is operated.

Furthermore, as shown in FIG. 9, an abutment part in which the lever part 16*b* abuts on the abutment surface 69 is set to such a position that, when the operation of the handle 15 causes the lever member 40 to pivot to a rotation position for the latch device to perform an unlatching operation, the abutment portion should be situated on a plane PL which includes the axis C of the spindle 44, and which is substantially parallel to the rotational axis of the first handle arm 16, namely, the axis of the pivotally-supporting pin 28.

In addition, between the second attachment part 43 and the counterweight 30, a circular window 71 is provided in the base member 14. A key cylinder (not illustrated) whose front end is faced to this window 71 is supported by the reinforcement plate 59.

Next, descriptions will be provided for operations in this exemplary embodiment. The counterweight 30 is attached to the first handle arm 16 installed continuously to the handle 15. This counterweight 30 integrally includes: the weight part 30*a* extending in the direction intersecting the first handle arm 16; and the reinforcement part 30*b* extending along the first handle arm 16, continuously from the weight part 30*a*. The reinforcement part 30*b* is in surface contact with the first handle arm 16. For these reasons, it is possible to disperse a load which the counterweight 30 exerts on the first handle arm 16; it is unnecessary to make the thickness of the first handle arm 16 larger; and it is thus possible to avoid the bulkiness of conventional door handle systems.

Furthermore, the first handle arm 16 integrally includes the arm part 16*a* and the lever part 16*b*, the arm part 16*a* having the one end which is provided continuously from the handle 15 and extending toward the inside of the door 12 as well as being provided in the opposite end portion thereof with the spindle hole 24; the lever part 16*b* extending in the direction substantially orthogonal to the longitudinal direction of the arm part 16*a*, one end portion of the lever part 16*b* extending continuously from the opposite end portion of the arm part 16*a*, the opposite end portion of the lever part 16*b* being interlocked and connected with the latch device. The pivotally-supporting pin 28 is inserted in the spindle hole 24. The counterweight 30 is attached to the one end portion of the lever part 16*b*. The reinforcement part 30*b* is formed extending along the lever part 16*b* in the direction which goes away from the opposite end portion of the arm part 16*a*. For these reasons, the attachment part in which the counterweight 30 is attached to the first handle arm 16 is set near the pivotally-supporting part of the first handle arm 16. This setting makes it possible to increase the strength of the attachment part in which the counterweight 30 is attached to the first handle arm 16 without making the thickness of the first handle arm 16 larger. Moreover, the rigidity of the lever part 16*b* interlocked and connected with the latch device can be increased by reinforcing the lever part 16*b* with the reinforcement part 30*b* extending along the lever part 16*b* in the direction which goes away from the opposite end portion of the arm part 16*a*. Accordingly, it is possible to make the total weight of the counterweight 30 relatively lighter.

In addition, the reinforcement part 30*b* extends continuously from the one end portion of the weight part 30*a* formed extending parallel to the rotational axis of the first handle arm 16. The extension part 30*c* extending in the direction orthogonal to the rotational axis of the first handle arm 16 extends integrally and continuously from the opposite end portion of the weight part 30*a*. For these reasons, it is possible to inhibit the center of gravity of the counterweight 30 from shifting to one side of the weight part 30*a* in its longitudinal direction.

In addition, the extension part 30*c* is disposed in the position close and opposed to the expanded-diameter part 28*a* of the one end of the pivotally-supporting pin 28. For this reason, the extension part 30*c* is capable of blocking the pivotally-supporting pin 28 from coming out of its intended position; a specialized part for preventing the pivotally-supporting pin 28 from coming out of position is no longer necessary; and it is possible to reduce the number of parts and the number of assembling steps. Furthermore, since no engagement part configured to engage with the base member 14 side for the purpose of blocking the pivotally-supporting pin 28 from coming out of position need be formed in the pivotally-supporting pin 28, the length and size of the pivotally-supporting pin 28 can be reduced to a minimum. This can contribute to constructing the door handle system in a smaller size.

Furthermore, the first handle arm 16 to which the counterweight 30 is attached, and the second handle arm 17, spaced away from the first handle arm 16, both extend continuously from the handle 15. The paired brackets 26, 27, configured to support the first and second handle arms 16, 17 in a way that the first and second handle arms 16, 17 are pivotable, are provided to the base member 14 in a way to be opposed to and in abutment with the first and second handle arms 16, 17 from the outer sides thereof. The weight part 30*a* of the counterweight 30 is integrally provided with the reception parts 36, 37 configured to abut on the first and second handle arms 16, 17 from the inner sides thereof. For these reasons, the movement of the two handle arms 16, 17 in the direction of the rotational axis is inhibited, and the space between the two handle arms 16, 17 is maintained by the reception parts 36, 37 of the counterweight 30. Accordingly, it is possible to prevent any loosening of the two handle arms 16, 17.

Further, the lever member 40 is supported by the base member 14 in a way that, when the lever member 40 pivots, part of the lever part 40 overlaps the counterweight 30. The lever member 40 links to the latch device, and pivots about the axis orthogonal to the plane including the rotational axis of the handle 15 in response to the rotational operation of the handle 15. The counterweight 30 is provided with the escape groove 41 for avoiding the interference with the lever member 40. For these reasons, the counterweight 30 can be disposed closer to the lever member 40, and it is possible to further contribute to constructing the door handle system in a smaller size.

Meanwhile, at least one portion of the base member 14 is attached to the outer panel 13 of the door 12. In this exemplary embodiment, the base member 14 is attached to the outer panel 13 by use of the first and second attachment parts 42, 43. The first attachment part 42 is disposed coaxially with the spindle 44, which is fixed to the base member 14 with the axis C of the spindle 44 being substantially at a right angle to the plane extending along the outer panel 13, in order to support the lever member 40 in a way that the lever member 40 is pivotable, the lever member 40 being linked to the latch device and interlocked and connected with the first handle arm 16 configured to pivot together with the handle 15. For this reason, even though multiple portions (the two portions in this exemplary embodiment) of the base member 14 are attached to the outer panel 13, no space need be secured in a place away from the lever member 40 for any such portion. Accordingly, it is possible to contribute to constructing the door handle system in a smaller size.

In addition, the first attachment part 42 includes: the attached surface 56 formed in the end portion of the spindle 44 on a side opposite from the base member 14; and the bolt 57 having the expanded-diameter head part 57*a* and being coaxially screwed into the spindle 44, with the reinforcement part 59 fixedly attached to the outer panel 13 being interposed between the expanded-diameter head part 57*a* and the attached surface 56. For this reason, the reinforcement plate 59 is interposed between the first attachment part 42 and the outer panel 13. Accordingly, while the handle 15 is operated, it is possible to disperse a force which is applied to the outer panel 13, and to prevent the outer panel 13 from deforming. In addition, the end portion of the spindle 44, which is opposite from the base member 14, is supported by the outer panel 13 with the reinforcement plate 59 interposed in between. For this reason, the supporting structure for the spindle 44 is configured as a structure in which the spindle 44 is supported at its two ends. Accordingly, it is possible to make the spindle 44 have enough strength to surely bear a force which is applied to the spindle 44 when the lever member 40 pivots.

The spindle 44, which is a body separated from the base member 14 made of a synthetic resin, is fixed to the support plate 47 attached to the base member 14. Accordingly, the spindle 44, whose diameter is relatively large for supporting the lever member 40, is not integrally formed with the base member 14, so that no consideration need be taken to shrinkage and the like which may occur on the surface of the base member 14. It is thus easy to mold the appearance of the base member 14.

Moreover, in this exemplary embodiment, the support member 48, the support plate 47, the spindle 44, the lever member 40, and the return spring 60 can be sub-assembled together as the lever member assembly unit 61 in advance. The attaching of this lever member assembly unit 61 to the base member 14 leads to the enhancement of the workability and efficiency for the attachment.

In addition, in order to pivot in response to the rotation of the handle 15, the lever member 40 is provided with the abutment surface 69 abutting on the lever part 16*b* of the first handle arm 16. When the lever member 40 pivots to the rotation position for bringing the latch device into the unlatched condition, the contact portion of the lever part 16*b* with the abutment surface 69 is situated on the plane PL which includes the axis C of the spindle 44, and which is substantially parallel to the rotational axis of the first handle arm 16. For these reasons, the size of the abutment surface 69 needed for the abutment surface 69 to be always in abutment on the lever part 16*b* of the first handle arm 16 configured to pivot can be set small. Accordingly, it is possible to construct the door handle system in a smaller size.

Figure 10B:
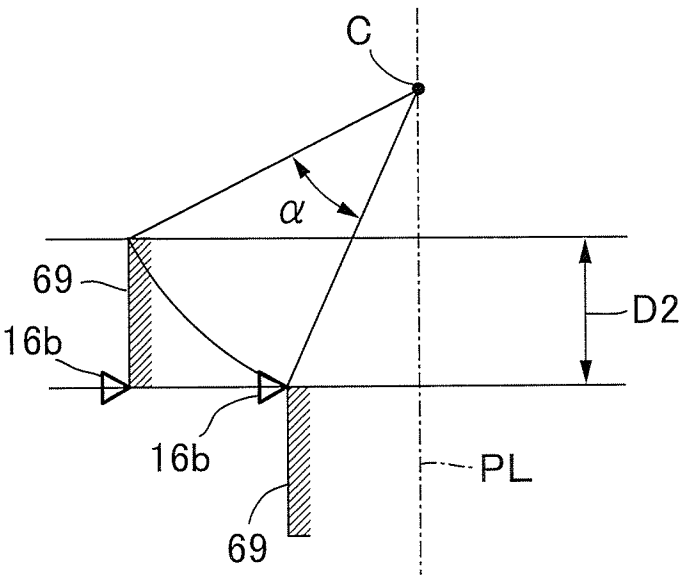
FIG. 10B is an explanatory view for explaining a size of an abutment surface of a lever member according to a second position of a contact portion of a lever part with an abutment surface.
Figure 10A:
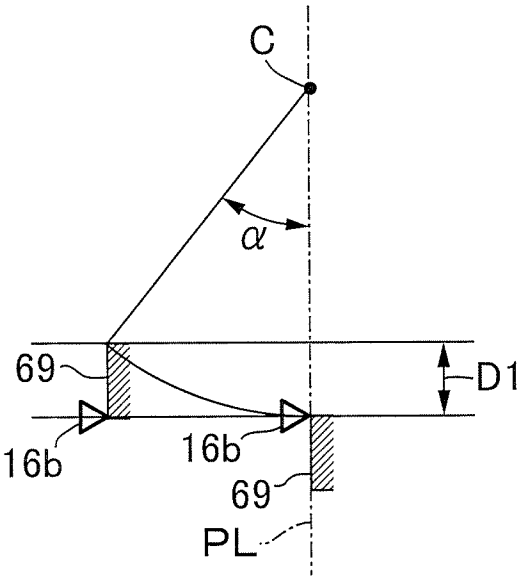
FIG. 10A is an explanatory view for explaining a size of an abutment surface of a lever member according to a first position of a contact portion of a lever part with an abutment surface.

In the case where the contact portion of the lever part 16*b* with the abutment surface 69 is set in a way to be situated on the plane PL including the axis C of the spindle 44 and being substantially parallel to the rotational axis of the first handle arm 16 when the lever member 40 is pivoted to the rotation position for bringing the latch device into the unlatched condition, a size D1 which the abutment surface 69 needs in order to keep the lever part 16*b* always in abutment on the abutment surface 69 is as shown in FIG. 10A. On the other hand, if the contact portion of the lever part 16*b* with the abutment surface 69 is situated in a position offset from the plane PL when the lever member 40 pivots to the rotation position for bringing the latch device into the unlatch condition, a size D2 which the abutment surface 69 needs in order to keep the lever part 16*b* always in abutment on the abutment surface 69 becomes larger than the size D1, as shown in FIG. 10B, in a case where the rotation angle $\alpha$ of the lever member 40 is set constant. Accordingly, the size which the abutment surface 69 needs in order to keep the lever part 16*b* always in abutment on the abutment surface 69 can be set smaller by setting the contact portion of the lever part 16*b* with the abutment surface 69 in a way that, when the lever member 40 pivots to the rotation position for bringing the latch device into the unlatched condition, the contact portion can be situated on the plane PL including the axis C of the spindle 44 and being substantially parallel to the rotational axis of the first handle arm 16.

An exemplary embodiment of the present invention is explained above, but the present invention is not limited to the above-mentioned exemplary embodiment and may be modified in a variety of ways as long as the modifications do not depart from the gist of the present invention.

For example, in the above-mentioned exemplary embodiment, explained is the case in which the first and second handle arms 16 and 17 extend continuously from the handle 15 and the counterweight 30 is attached to the first handle arm 16. However, it is possible to apply the present invention to a door handle system in which a counterweight is attached to a single handle arm extending continuously from a handle.

The invention claimed is:

1. A vehicle door handle system comprising: a handle pivotally supported by a base member, at least one portion of the base member being attached to an outer panel of a vehicle door; and a lever member pivotally supported by a spindle fixed to the base member and having an axis extending through the outer panel substantially at a right angle to the outer panel, the lever member being interlocked in abutment with a handle arm configured to pivot with the handle, the lever member is configured to be linked to a latch device, and wherein an attachment part which attaches the base member to the outer panel is fixed coaxially with the spindle, the attachment part comprising an attached surface formed in an end portion of the spindle on a side opposite from the base member and a bolt having an expanded-diameter head part and coaxially screwed to the spindle, the expanded-diameter head part interposing a reinforcement plate between the attached surface and the expanded-diameter head part, and the reinforcement plate being fixedly attached to the outer panel.

2. The vehicle door handle system according to claim 1, wherein the base member is made of a synthetic resin, the spindle is fixed to a support plate attached to the base member, and the spindle is a body separated from the base member.

3. The vehicle door handle system according to claim 1, wherein in order to pivot in response to rotation of the handle, the lever member is provided with an abutment surface abutting on the handle arm, and when the lever member pivots to a rotation position for achieving an unlatched condition, a contact portion of the handle arm contacting with the abutment surface is set to be situated on a plane which includes an axis of the spindle, and which is substantially parallel to a rotational axis of the handle arm.

4. The vehicle door handle system according to claim 1, wherein the handle arm extends continuously from the handle disposed in an external surface of the door and is pivotally supported by the base member by use of a pivotally-supporting pin, and a counterweight attached to the handle arm integrally includes a weight part which extends in a direction intersecting the handle arm and a reinforcement part which extends continuously from the weight part in a direction along the handle arm and is in surface contact with the handle arm.

5. The vehicle door handle system according to claim 4, wherein the handle arm integrally includes an arm part and a lever part, the arm part having an end which extends continuously from the handle toward an inside of the door and includes a spindle hole in an opposite end portion thereof, the lever part extending in a direction substantially orthogonal to a longitudinal direction of the arm part, one end portion of the lever part extending continuously from the opposite end portion of the arm part, an opposite end portion of the lever part is configured to be interlocked and connected with the latch device, the pivotally-supporting pin is inserted in the spindle hole, the counterweight is attached to the one end portion of the lever part, and the reinforcement part of the counterweight is formed extending along the lever part in a direction extending away from the opposite end portion of the arm part.

6. The vehicle door handle system according to claim 4, wherein the reinforcement part extends continuously from one end portion of the weight part extending in a direction parallel to a rotational axis of the handle arm, and an extension part which extends in a direction orthogonal to the rotational axis of the handle arm extends integrally and continuously from an opposite end portion of the weight part.

7. The vehicle door handle system according to claim 5, wherein the reinforcement part extends continuously from one end portion of the weight part extending in a direction parallel to a rotational axis of the handle arm, and an extension part which extends in a direction orthogonal to the rotational axis of the handle arm extends integrally and continuously from an opposite end portion of the weight part.

8. The vehicle door handle system according to claim 6, wherein the extension part is disposed in a position close to and opposed to one end of the pivotally-supporting pin.

9. The vehicle door handle system according to claim 4, wherein a first handle arm to which the counterweight is attached and a second handle arm which is disposed spaced apart from the first handle arm extend continuously from the handle, paired brackets for pivotally supporting the first and second handle arms, are provided on the base member in a way to be opposed to and in abutment with the first and second handle arms from outer sides thereof, and the weight part is integrally provided with reception parts which abut the first and second handle arms from inner sides thereof.

10. The vehicle door handle system according to claim 4, wherein the lever member configured to be linked to the latch device and rotating about an axis orthogonal to a plane including a rotational axis of the handle in response to rotational operation of the handle is supported by the base member in a way that part of the lever member overlaps the counterweight during its rotation, and the counterweight is provided with an escape groove for avoiding interference with the lever member.

11. The vehicle door handle system according to claim 1, including a second attachment part with which to attach the base member to the outer panel is provided at a frontward position of the base member, the second attachment part including a nut fixed to the base member and a bolt which screws into the base member with the outer panel and the reinforcement member interposed therebetween.

12. A vehicle door handle system comprising:

a handle pivotally supported by a base member, at least one portion of the base member being attached to an outer panel of a vehicle door;

a first handle arm integrally installed continuously with an inner surface of a lower portion of the handle;

a second handle arm integrally installed continuously with an inner surface of an upper portion of the handle;

paired brackets provided on an inner surface of a middle portion of the base member;

a counterweight attached to said first handle arm;

a lever member pivotally supported by a spindle fixed to the base member and having an axis extending through the outer panel substantially at a right angle to the outer panel; and an attachment part which attaches the base member to the outer panel, fixed coaxially with the spindle, wherein the attachment part comprises an attached surface formed in an end portion of the spindle on a side opposite from the base member and a bolt having an expanded-diameter head part and coaxially screwed to the spindle, the expanded-diameter head part interposing a reinforcement plate between the attached surface and the expanded-diameter head part, the reinforcement plate being fixedly attached to the outer panel, the first and second handle arms are pivotally supported by the paired brackets, the lever member is interlocked in abutment with the first handle arm such that the lever member and the first handle arm are configured to pivot together with the handle, and the lever member is configured to be attached to a latch device.

13. The vehicle door handle system of claim 12, wherein the counterweight integrally includes a weight part which extends in a direction intersecting the first handle arm and a reinforcement part which extends from the weight part and extends continuously in a direction along the first handle arm, wherein the reinforcement part is in surface contact with the first handle arm.

14. The vehicle door handle system of claim 13, wherein the first handle arm includes an arm part and a lever part, the arm part having one end which is provided continuously from the handle and the lever part extends in a direction substantially orthogonal to the longitudinal direction of the arm part and an end portion of the lever part opposite the arm part is configured to be interlocked and connected with the latch device.

15. The vehicle door handle system of claim 14, wherein the arm part is provided with a spindle hole at an end opposite the handle, and a pivotally-supporting pin is inserted into the spindle hole and the paired brackets.

16. The vehicle door handle system of claim 14, wherein the counterweight is attached to the lever part.

17. The vehicle door handle system of claim 14, wherein the reinforcement part is formed to extend along the lever part in a direction which goes away from the arm part such that the counterweight is attached to the first handle arm near a pivotally supporting part of the first handle arm.

* * * * *